United States Patent [19]

Schuster

[11] Patent Number: 5,022,525

[45] Date of Patent: Jun. 11, 1991

[54] WRAP-AROUND CARRIER WITH ADJUSTABLE BOTTLE NECK OPENINGS

[75] Inventor: Richard L. Schuster, Monroe, La.

[73] Assignee: Manville Forest Products Corporation, Denver, Colo.

[21] Appl. No.: 514,789

[22] Filed: Apr. 25, 1990

[51] Int. Cl.[5] ..... B65D 65/24

[52] U.S. Cl. ..... 206/434; 229/40; 206/158

[58] Field of Search ..... 229/40; 206/152, 158, 206/434

[56] References Cited

U.S. PATENT DOCUMENTS

| | | | |
|---|---|---|---|
| 3,073,644 | 1/1963 | Baker et al. | 206/158 |
| 3,154,827 | 11/1964 | Gentry | 206/152 X |
| 3,224,577 | 12/1965 | Hansen | 206/158 |
| 3,269,531 | 8/1966 | Weiss | 229/40 |
| 3,367,557 | 2/1968 | Farquhar | 529/40 |
| 3,373,867 | 3/1968 | Wood | 229/40 |
| 3,519,127 | 7/1970 | Wood | 229/40 X |
| 3,674,137 | 7/1972 | Graser | 229/40 |
| 4,373,630 | 2/1983 | Oliff | 229/40 |
| 4,374,562 | 2/1983 | Oliff | 229/40 |
| 4,437,606 | 3/1984 | Graser | 229/40 |
| 4,815,599 | 3/1989 | Schuster | 229/40 |

*Primary Examiner*—William I. Price
*Attorney, Agent, or Firm*—John Lister

[57] ABSTRACT

A wrap-around bottle carrier having bottle neck openings comprised of arcuate edges. The arcuate edges engage bottle necks of minimum circumference to hold then in place. Concentric arcuate fold lines located radially outwardly of the openings are connected to the arcuate edges by slits to form flaps which can fold up to permit bottle necks of greater circumference to be received and held in place by the openings. The openings may be located adjacent the side panels of the carrier, in which case slits extending from the arcuate edges of the openings may be located in the side panels.

9 Claims, 3 Drawing Sheets

WRAP-AROUND CARRIER WITH ADJUSTABLE BOTTLE NECK OPENINGS

FIELD OF THE INVENTION

This invention relates to wrap-around article carriers, and more particularly, to wrap-around bottle carriers with openings in the top panel for receiving the necks of bottles contained in the carrier.

BACKGROUND OF THE INVENTION

Wrap-around carriers are quite often used to package beverage bottles. This is commonly carried out by positioning a carrier blank on the tops of the bottles to be packaged, folding the sides of the blank down and forming a bottom panel from flaps extending from the side panels. The bottles typically are carried through a packaging machine by transporting means which provides space for folding the flaps and for connecting mechanical locking elements on one flap with corresponding openings in another flap. In the type of carrier under discussion openings are provided in the top panel to receive the necks of bottles contained in the carrier.

A problem encountered in the use of wrap-around carriers to package bottles is the fact that bottles which are of the same nominal size are not always the same actual size. Thus the wrapper of a package containing relatively large size bottles would normally fit very tightly about the bottles compared to the wrapper of a package containing relatively small size bottles. This condition has been alleviated by using carrier blanks provided with two different sets of mechanical locks, one set of which is actuated when the perimeter of the package is relatively large, due to the presence of oversized bottles, and the other set of which is actuated when the perimeter of the package is relatively small, due to the presence of undersized bottles. The locks have typically been located on bottom panel flaps used to form the bottom panel of the carrier. Examples of such carriers may be found in U.S. Pat. No. 3,548,566, issued on Dec. 22, 1970 to Earle C. Sherman, and U.S. Pat. No. 4,437,606, issued on Mar. 20, 1984 to Earl J. Graser.

While these measures were effective in providing for a tight package of bottles which could vary in size within relatively small predetermined limits, it has been found that bottles used today tend to vary in size more than they previously did, making it more difficult to compensate for size differences by the different sets of mechanical locks discussed above. This appears to be the result of high volume bottle forming operations which have reduced the lifetime of the bottle molds. It is now necessary to clean and polish the molds more often. Since the polishing operation is abrasive, it reduces the wall thickness of the molds each time it is carried out, resulting in larger molds which produce larger size bottles.

To redesign the carrier locking means to accommodate these larger variations in bottle size would require the carrier locking panels to be made larger, which is undesirable from a cost standpoint. It would be highly desirable, therefore, to be able to provide a tight wrap-around carrier which compensates for large variations in bottle size without resulting in costly design changes to either the carrier itself or the packaging machine.

BRIEF SUMMARY OF THE INVENTION

The invention solves the problem of oversize bottles by providing the bottle neck openings in the top panel of the carrier with arcuate edge portions substantially corresponding in shape to the transverse contour of the bottle necks. The openings are of a size such that the arcuate edge portions will engage a bottle neck of minimum circumferential dimension. Means are further provided for causing the arcuate edge portions to be moved radially outwardly by an associated bottle neck having a circumference greater than the minimum circumferential dimension but not greater than the maximum circumferential dimension.

In a preferred embodiment the latter means comprises arcuate fold lines in the top panel located radially outwardly of the openings, with each arcuate edge portion being connected to an associated arcuate fold line to form a flap which folds upwardly during relative movement of an oversize bottle neck through the opening. The openings are further preferably located adjacent the folds connecting the top panel to the side panels to allow the bottles to snugly fit within the carrier adjacent the side panels.

The invention is able to accommodate bottles of such oversize dimension that if the usual combination of oversize and undersize mechanical locking tabs were employed instead, the locking panel would have to be 5/16 inch wider than normal. The design not only provides for the use of a carrier requiring no extra material, but permits use of the same machinery employed to package bottles in wrappers provided with sets of oversize and undersize locking elements. Thus the overhead hold-down rail which normally engages the top panel of the carrier to prevent it from moving up during the folding and locking operations functions to push the carrier blank of the invention down over the necks of oversize bottles to the desired location of the top panel. If desired, alternate oversize and undersize sets of mechanical locking elements may be retained in the carrier and used in addition to the bottle neck opening design of the invention.

The above and other aspects of the invention, as well as other benefits, will readily be apparent from the more detailed description of the preferred embodiment which follows.

DETAILED DESCRIPTION OF THE PREFERRED EMBODIMENT

Figure 1:
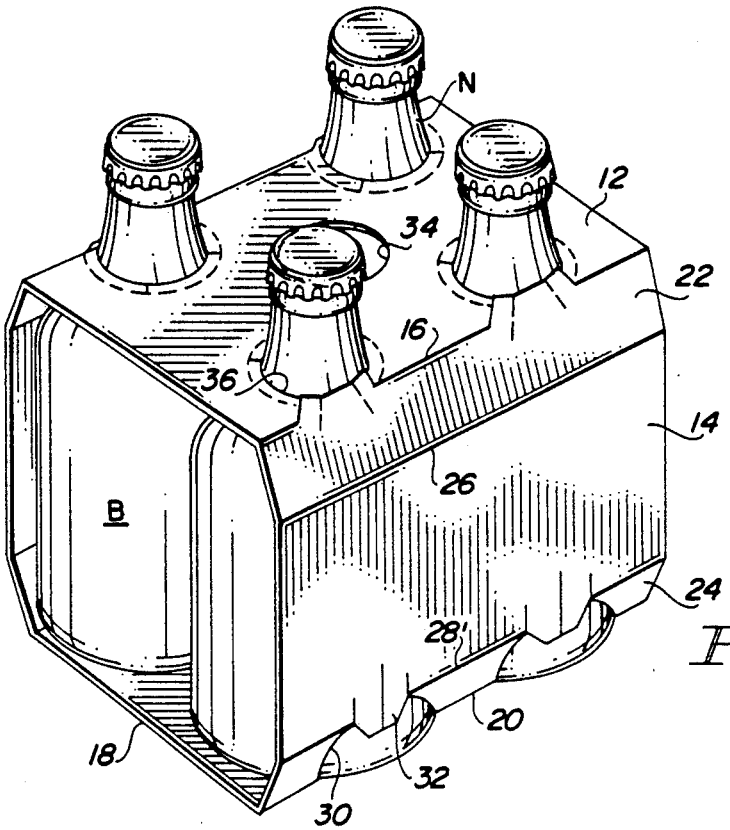
FIG. 1 is a pictorial view of the wrap-around carrier of the present invention which has been formed about necked bottles.
Figure 2:
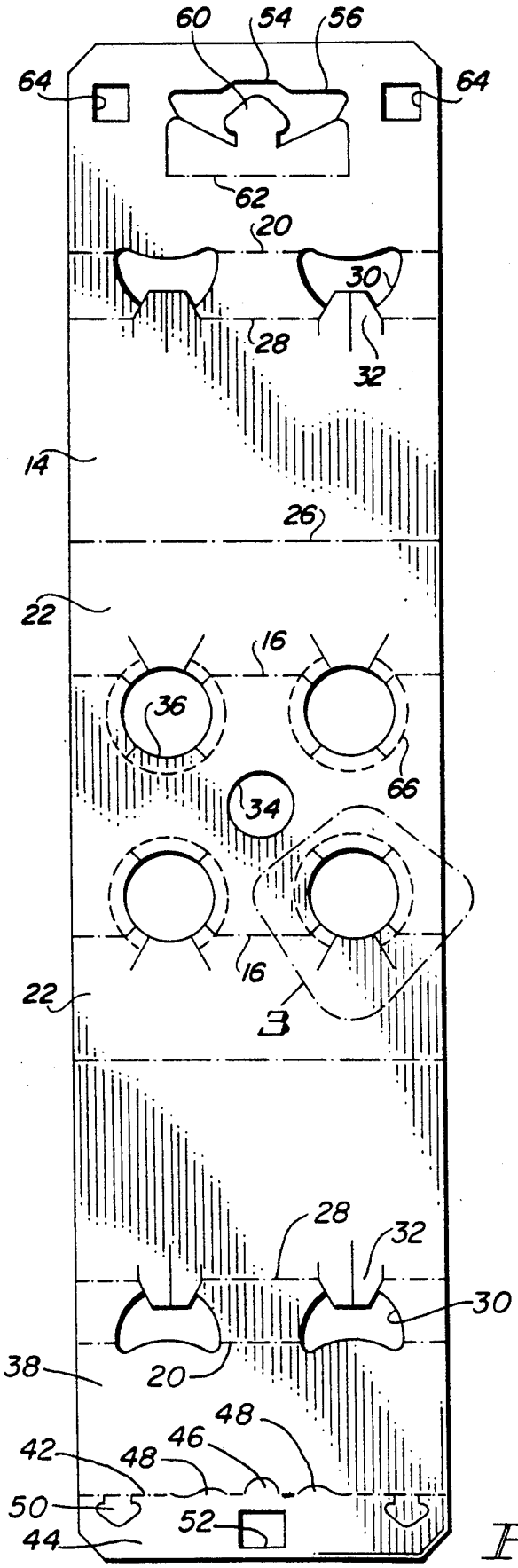
FIG. 2 is a plan view of a blank for forming the carrier of FIG. 1.

Referring to FIG. 1, the carrier 10 is comprised of a top panel 12 connected to side panels 14 along folds 16. A bottom panel 18, formed from flaps shown in more detail in FIG. 2, is also connected to the side panels 14 along fold lines 20. The side panels 14 include short sloped panel sections 22 and 24 connected along score lines 26 and 28, respectively. The sloped panel sections generally follow the contour of the bottles B enclosed in the carrier to provide for holding the bottles snugly in place. The lower sloped panel section 24 contains heel openings 30 through which the adjacent bottom portions of the bottles extend. Tabs 32, extending down from the side panel 14, also assist in holding the bottoms of the bottles in place. The top panel 12 contains a finger hole 34 for lifting the carrier and openings 36 through which the necks N of the bottles B extend.

The carrier of FIG. 1 is formed from the production blank of FIG. 2, wherein like reference numerals denote similar components. The bottom panel of the carrier is formed from bottom panel flaps 38 and 40. The bottom panel flap 38 contains a fold line 42 which is parallel to and spaced from the end of flap 38 to form a margin portion 44. An oversized position tab 46, located substantially midway between the side edges of the blank extends from the fold line 42 away from the margin 44. Also extending from the fold line 42 are undersized position tabs 48 located on opposite sides of the tab 46. The fold line 42 is interrupted in the location of the tabs 46 and 48 so that the tabs are not rigidly connected to the margin 44 and are not folded along the fold line 42. The undersized position tabs 48 extend away from the fold line 42 a distance less than the distance that oversized position tab 46 extends. In addition to the above primary lock structure, the flap 38 may include other locking means such as tertiary punch style locking tabs 50, which are connected to fold line 42, and secondary locking opening 52, which is located centrally of the margin portion 44.

In the bottom flap 40 the oversized position primary locking slot or edge 54 is located so as to be engaged by the primary oversized locking tab 46. Similarly, undersized position primary locking slots or edges 56 are located outwardly of the edge 54 so as to be engaged by the primary undersized locking tabs 48. The edges 54 and 56 are part of the cutout 58 into which the secondary punch style locking tab 60 extends. The secondary tab 60 is positioned to engage the secondary locking opening 52 and is connected to the end section 40 by fold line 62. Tertiary locking openings 64 are located in the end section 40 so as to engage with tertiary locking tabs 50.

In practice, the blank is folded about a package and the primary, secondary and tertiary locking tabs are inserted into their corresponding openings to form the bottom panel and to lock the bottom panel flaps securely in place. Depending on the size of the bottles, either the undersized or the oversized primary tabs and openings will be engaged. This is a well known locking procedure in the industry which does not form a part of the present invention, but is shown to illustrate the ability to retain conventional oversize and undersize locking features, if desired, in addition to the features of the invention. For more details on the locking sequence, attention is directed to U.S. Pat. No. 4,815,599 issued on Mar. 28, 1989 to Richard L. Schuster.

Figure 3:
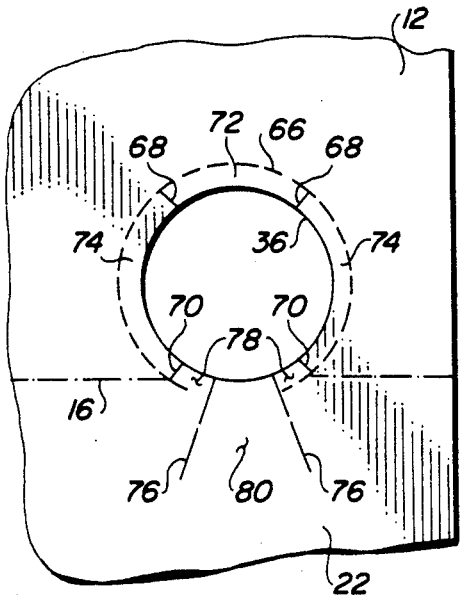
FIG. 3 is an enlarged plan view of the opening contained within the perimeter 3 in the top panel section of the carrier blank shown in FIG. 2.

Still referring to FIG. 2, and also to FIG. 3, the blank is provided with openings 36 corresponding to the bottle neck openings of FIG. 1. The openings are circular, corresponding in shape and size to the circumference of a bottle neck of minimum dimensions at the point where the neck is to be engaged. The openings extend to a point slightly beyond an extension of the score line 16 in order to permit the bottles to be positioned adjacent the side panels of the carrier. Spaced radially outwardly from the edges of the openings are substantially concentric fold lines 66 which do not, however, extend completely around the circumference of the openings. The fold lines 66 terminate slightly beyond the score lines 16 in the sloped side panel section 22. Extending radially from the openings 36 to the fold lines 66 are slits 68 and 70 which create curved flaps or tabs 72 and 74. Thus the flap 72 is defined by the arcuate fold line 66, the arcuate edges of the opening 36 and the slits 68. Similarly, the flaps 74 are defined by the fold line 66, the arcuate edges of the opening 36 and the slits 68 and 70. The slits 70 extend from the score line 16 to the opening 36. A short distance beyond the slits 70 are two interrupted slits 76 which extend from a point on the opening aligned with the score line 16 for a substantial distance into the sloped panel section 22. Thus the edge of the opening 36, the arcuate fold line 66 and the slits 70 and 76 define small tabs or flaps 78. The portion of the sloped panel section 12 between the tabs 78 comprises a tab 80 which is not connected to a fold line but simply extends into the sloped panel section for a distance corresponding to the length of the interrupted slits 76.

Although the bottle neck openings have been shown as circular to correspond to the circular transverse cross-sectional shape of the bottle necks, it should be understood that the arcuate edge of each opening 36 could just as well correspond to a shape other than a circle, such as an oval, if the transverse cross-sectional shape of the bottle neck is other than a circle.

Figure 4:
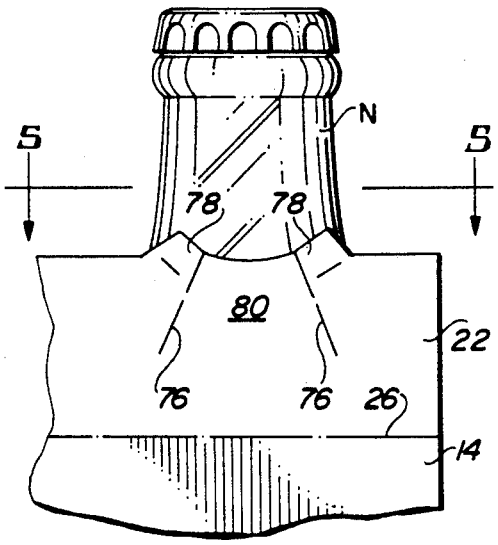
FIG. 4 is an enlarged side view of one of the openings in the carrier of FIG. 1 and its associated bottle neck.
Figure 5:
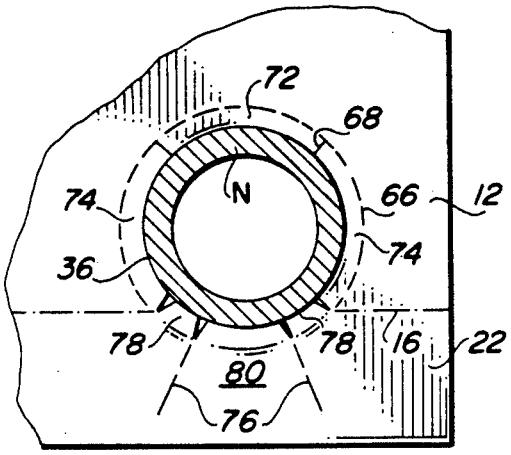
FIG. 5 is a sectional view taken on line 5—5 of FIG. 4.

Referring now to FIGS. 4 and 5, a bottle neck N of the minimum predetermined circumference is shown extending up through an opening 36. Because the circumference of the opening is substantially the same as the circumference of the bottle neck, the arcuate edges of the flaps 72 and 74 engage the bottle neck while the flaps 72 and 74 remain in the plane of the top panel 12 of the carrier. Because the folding of the score line 16 causes the tabs 78 and the larger tab 80 to lie substantially in the same plane as the short sloped side panel section 12, these tabs extend up beyond the top panel 12. As shown best in FIG. 5, the upward folding of the tabs 78 results in the tabs 78 being separated from the flaps 74 along the slits 70.

Figure 6:
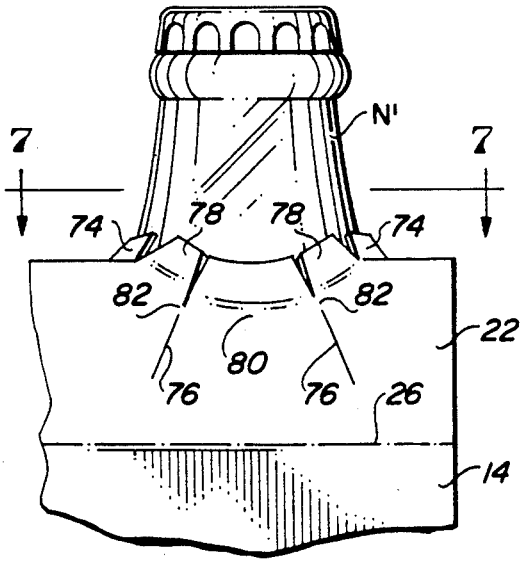
FIG. 6 is an enlarged side view similar to that of FIG. 4, but showing the carrier opening in association with a bottle neck of greater circumference.
Figure 7:
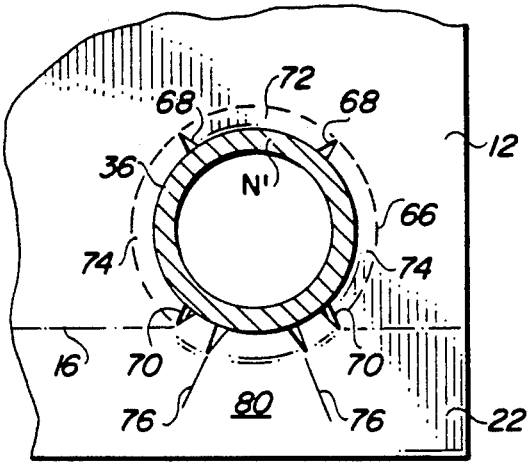
FIG. 7 is a sectional view taken on line 7—7 of FIG. 6.

When a bottle of greater circumferential dimension is introduced to a carrier it is held in place in the manner illustrated in FIGS. 6 and 7. As illustrated, the greater circumference of the bottle neck N' pushes the flaps 72 and 74 up so that they fold up about the arcuate fold line 66. This effective increase in the circumference of the bottle neck opening 36 is made possible by the spreading apart of the slits 68 and 70. In addition, the greater thickness of the bottle neck forces the tabs 78 and 80 farther apart, which is made possible by the interrupted slits 76 spreading apart adjacent the opening 36. Although not shown, if the thickness of the bottle required it, the strip of material 82 separating the slit portions that make up each interrupted slit 76 would tear, allowing the slits 76 to separate even more adjacent the bottle neck opening.

A feature of the invention that causes the arcuate edges of the tabs or flaps 72 and 74 to be maintained in close engagement with a bottle neck is the arcuate fold line 66. If, for example, the flaps 72 and 74 were connected to the top panel along straight fold lines, they would not be biased against the bottle necks. They would simply fold up about their fold lines and not exert much pressure to return to their original position. The arcuate fold line, however, acts to bias the flaps 72 and 74 toward their original position in the plane of the top panel. Thus when forced upward by a bottle neck of greater than the predetermined minimum size, this bias maintains the flaps 72 and 74 in engagement with the bottle neck.

Although the number and extent of the flaps 72 and 74 may be varied as required, it can be seen that if they are provided as a large number of narrow tabs, their arcuate fold lines will be too short to provide much bias toward their initial position. It is preferred, therefore, that the circumference of the opening lying in the top panel between the slits 70 be provided with no more than eight evenly spaced slits in order to preserve the necessary bias in the resulting tabs.

Figure 8:
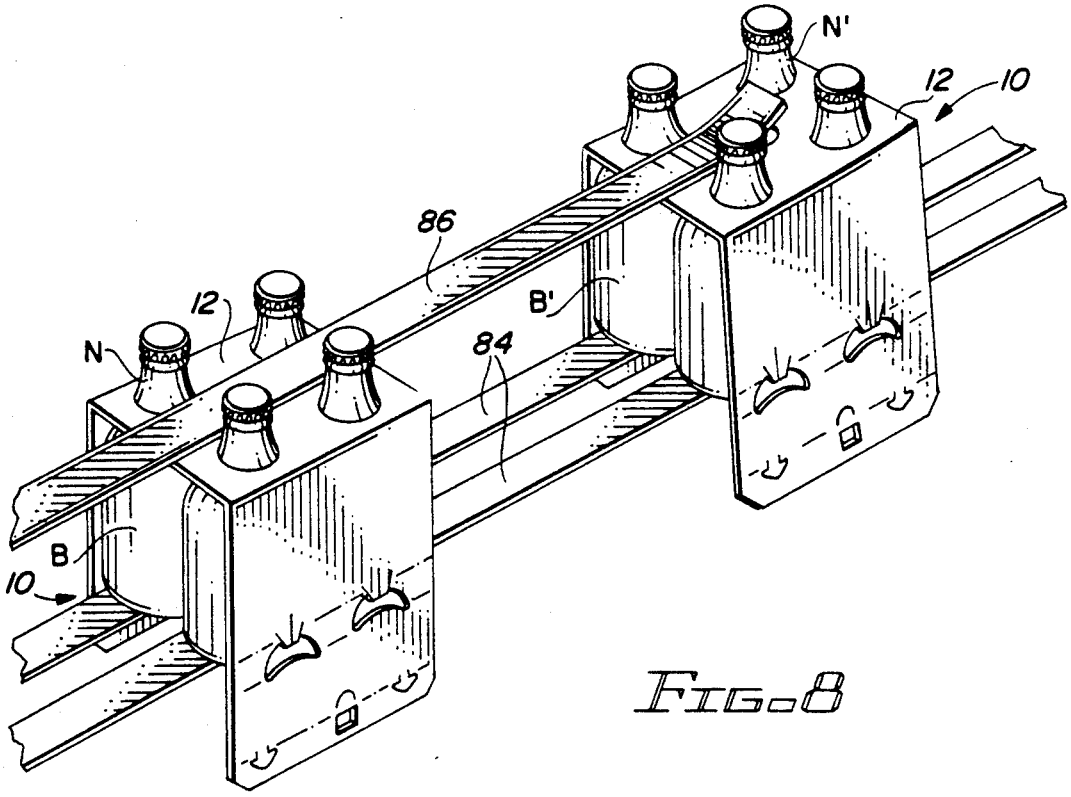
FIG. 8 is a pictorial schematic view of the top panel hold-down section of a packaging machine for forming carriers from wrap-around carrier blanks.

In the process of forming the wrap-around carrier of the invention, blanks of the type shown in FIG. 2 are deposited over groups of bottles to be packaged so that the bottle neck openings in the top panel are aligned with the bottle necks. As schematically illustrated in FIG. 8, the bottles are moved along a support, such as spaced support strips 84, by any suitable moving means, not shown. The blank is folded during movement of the blank and bottles through the packaging machine by well known folding means, and the bottom panel flaps are connected together at a downstream location by any suitable punching means, not shown but also well known in the art. Positioned overhead is a stationary hold-down rail 86 commonly employed to engage the top panel of a carrier blank as it moves past to hold the carrier blank in place during the various folding and lock punching operations. If the bottles in a carrier blank are of normal or minimum size, as is the case with the downstream carrier containing bottles B, the openings in the top panel will allow the blank to readily seat at the correct height on the bottle necks N. In this case the hold-down rail 86 performs its usual function. If one or more bottles in a carrier are greater than the minimum predetermined size, as illustrated by the upstream carrier containing bottles B', the openings associated with those bottles will cause the blank to seat at a point higher than the design point. Continued downstream movement of the carrier blank will cause the stationary rail 86 to force the top panel down over the oversized bottle necks N', so that the tabs surrounding the openings will be folded up as explained above. It can be seen that the carrier of the invention permits the use of conventional packaging machine equipment without requiring expensive modification.

Although the invention has been described in connection with a carrier designed to hold four bottles, obviously it can also be used with carriers designed to hold a different number.

Also, although the invention has been described in connection with a carrier containing short sloped side panel sections for better holding the bottles in place, the concept of the invention could be used in other carrier designs as well. Further, it will be understood that if the bottle neck openings in the top panel are spaced far enough from the side panels so that the openings do not end adjacent the side panels, the openings could be surrounded completely by tabs of the type illustrated by reference numerals 72 and 74.

As indicated previously, it has been found that the carrier design of the present invention is able to receive bottles which are so greatly oversize that the usual oversize/undersize locking tabs and openings would require the locking panel to be 5/16 inch greater in width in order to accommodate bottles of such dimension. When considering the large number of carrier blanks needed to supply a packaging machine, the value of the material savings of the design is evident.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. A wrap-around carrier for containing bottles having a neck the circumference of which is of a predetermined contour and may vary between a predetermined minimum dimension and a predetermined maximum dimension, comprising:

a top panel;

side panels connected to the top panel along fold lines;

the top panel containing openings for receiving the necks of the bottles;

the openings having arcuate edge portions substantially corresponding in shape to the transverse contour of the bottle necks;

the openings being of a size such that the arcuate edge portions thereof engage an associated bottle neck of minimum circumferential dimension; and arcuate fold lines in the top panel located radially outwardly of the openings, each arcuate edge portion being connected to an associated arcuate fold line by slits to form a flap which folds upwardly during relative movement of an associated bottle neck having a circumference greater than the minimum circumferential dimension but not greater than the maximum circumferential dimension so that the openings are able to receive and engage such a bottle neck.

2. The wrap-around carrier of claim 1, wherein each opening has two flaps having an end edge terminating at the fold connecting the top panel to the nearest side panel.

3. The wrap-around carrier of claim 2, wherein an arcuate edge portion of each opening extends between the end edges terminating at said fold, and wherein at least one further slit extends from said arcuate edge portion into the adjacent side panel.

4. The wrap-around carrier of claim 3, wherein the further slit and one of the end edges terminating at said fold comprise the end edges of a further flap, the further flap being further defined by an arcuate edge portion of the opening and a portion of the aforesaid arcuate fold line, said portion of the arcuate fold line lying in the adjacent side panel.

5. The wrap-around carrier of claim 4, wherein there are two further slits extending from said arcuate edge portion into the adjacent side panel, and wherein said two further slits define the end edges of an additional flap.

6. The wrap-around carrier of claim 1, wherein the arcuate edge portions of the openings comprise a substantially continuous circular opening and the arcuate fold lines are concentric to the arcuate edge portions of the opening.

7. The wrap-around carrier of claim 1, including a bottom panel comprising two flaps connected by a mechanical lock, the mechanical lock including oversized and undersized locking means for further compensating for bottles of varying circumferences.

8. A blank for forming a wrap-around carrier for containing bottles having a neck of predetermined contour the circumference of which may vary between a predetermined minimum dimension and a predetermined maximum dimension, comprising:

a top panel section;

side panel sections connected to the top panel along score lines;

the top panel section containing openings for receiving the necks of the bottles;

the openings having arcuate edge portions substantially corresponding in shape to the transverse contour of the bottle necks;

the openings being of a size such that the arcuate edge portions thereof engage an associated bottle neck of minimum circumferential dimension; and arcuate fold lines in the top panel section located radially outwardly of the openings, each arcuate edge portion being connected by slits to an associated arcuate fold line to form a flap which folds upwardly during relative movement of an associated bottle neck having a circumference greater than the minimum circumferential dimension but not greater than the maximum circumferential dimension so that the openings are able to receive and engage such a bottle neck.

9. The blank of claim 8, wherein the arcuate edge portions of the openings comprise a substantially continuous circular opening, and wherein the arcuate fold lines are concentric to the arcuate edge portions of the opening.

* * * * *